US005865715A

United States Patent [19]

Wallick

[11] Patent Number: 5,865,715

[45] Date of Patent: Feb. 2, 1999

[54] CONTRACTION RESISTANCE VAGINAL MUSCLE EXERCISER

[76] Inventor: H. David Wallick, 5575 Wilde Oak Way, Sarasota, Fla. 34232

[21] Appl. No.: 9,556

[22] Filed: Jan. 20, 1998

[51] Int. Cl.[6] ..... A63B 21/02

[52] U.S. Cl. ..... 482/124; 482/121; 601/46

[58] Field of Search ..... 482/121, 122, 482/124, 44, 49; 600/38; 601/46

[56] References Cited

U.S. PATENT DOCUMENTS

| | | | |
|---|---|---|---|
| 843,291 | 12/1907 | Mullins | 482/49 |
| 2,837,334 | 6/1958 | Long | 482/49 |
| 3,003,764 | 10/1961 | Yovanovitch | 482/49 |
| 3,687,458 | 8/1972 | Protor, Jr. | 482/49 |
| 3,926,178 | 12/1975 | Feldzamen | 601/46 |
| 4,572,503 | 2/1986 | Ho | 482/49 |
| 5,372,557 | 12/1994 | Ostigny | 482/49 |

*Primary Examiner*—Lynne A. Reichard
*Attorney, Agent, or Firm*—Richard J. Grundstrom

[57] ABSTRACT

A resistance exerciser for the vaginal muscles having a first member, a second member, an adjustment and locking apparatus and a system to provide bias. The first member and second member are joined together at a rear ends of both members by a hinge to form the overall unit. Bias is provided between the members to bias the members from a closed position to an open position. The adjustment and locking apparatus controls the opening width between the first and second members and is used to maintain the exerciser in a closed position for insertion and storage.

The first member has a tapered head region for ease of insertion into the orifice of the vagina. The second member is joined with the first member from just behind the head region and extends to the rear of both the first and second members where they are attached with a hinge. Just behind the head region is a muscle positioning region consisting of an abrupt inward tapering, a flattened portion and an abrupt outward tapering. The virginal muscles contract onto the muscle positioning portion. The abrupt tappers prevents the exerciser from slipping inward or outward during use.

Once inserted, the exerciser is adjusted such that the first and second members can open due to the bias. The adjustment of the width of the opening also adjusts the amount of bias being applied. The muscles are then contracted about the flattened portion to close the first and second members. When the muscles are relaxed, the bias again spreads or opens the first and second members. This cycle is repeated to exercise the virginal muscles.

10 Claims, 5 Drawing Sheets

CONTRACTION RESISTANCE VAGINAL MUSCLE EXERCISER

BACKGROUND OF THE INVENTION

The present invention relates to a contraction resistance vaginal muscle exerciser and more particularly to an exercise device that provides contractual resistance to exercise and tone the muscles of the urogenital triangle of the female.

Currently, there is much interest in health and fitness in both men and women. People are becoming more heath conscience. Those that are taking action to improve their health are beginning various exercise programs, in addition to eating better and taking better care of their bodies in general.

There are two basic types or methods of exercise, isometric and isotonic methods. Isometric, in a broad sense, is the contraction, relaxation and stretching of muscles without any external forces. Isotonic methods utilize external forces that act against or with specific muscles in particular directions. Both isometric and isotonic methods can bring about significant gains in strength within muscles in various lengths of time.

One of the greatest advantages of the isotonic method is that there are significant strength gains in specific relation to the angles at which resistance is applied. The isotonic exercise, as such, can be designed to work an entire range of motions and muscles in one contraction. Whereas, an isometric method may take several different contractions to work the same muscles and range of motion. It has also been generally stated the isotonic methods build larger muscles, provides greater muscle mass, longer endurance, and better motor ability.

The chief advantage of the isometric method is that no or very little external equipment is needed. This means that it is very handy and convenient, in that they can be performed any time at almost any location. Since the isotonic method typically builds larger and stronger muscles somewhat quicker, the isotonic method may also have psychological advantages, in that the person can see and feel the results of the exercise more readily and quicker.

Within the perineum or urogenital region of the female there are several muscles, including the traverse superficial, bulbocavernosus, ischiocavernosus, traverse profundus and the sphincter urethrae. These muscles are all joined and are generally continuous with the urogenital diaphragm. These muscles are used for many different functions. These muscles provide muscle control of the orifice of the vagina. The contractions and relaxation control blood flow to the clitoridis. Contribute to the erection of the clitoris, and provide control of the urethra. These are just a few of many functions controlled by these muscles.

The toning and muscle development of these muscles are beneficial in both bladder and virginal control. In addition, muscle tone and development often result in better and more fulfilling sexual relationships. This is due to better blood flow to the clitoridis and constriction of the veins thereof. Without muscle toning and control, the deep dorsal vein cannot be completely constricted and blood is allowed to return through veins. As such, an erect clitoris during a sexual relationship cannot be maintained. Muscle toning and development results in controlling an erect and sensitive clitoris that can be maintained to provide a more satisfying experience and/or organism. Plus, virginal control allows the women better feel and control for both herself and her partner during intercourse.

Typically, to address these and other problems physicians and other professionals recommended kegel exercises. The kegel exercise is an isometric method of contracting and relaxing the muscle of the urogenital region. There is no resistance or isotonic methods involved. Although this exercise improves muscle tone and strength, the results are not very apparent. The muscles are developed very slowly and the results are not readily observed or felt. As a result, women are discouraged and are not prone to maintain a regular exercise routine.

The invention herein described overcomes these problems. The contraction resistance vaginal muscle exerciser of this invention provides an isotonic method of exercising the muscles of the urogenital region or the perineum. Muscle development occurs relatively rapid. Larger muscles are developed with better control and longer endurance in a relatively shorter time. Therefore, women can observe and feel the results. As such, women are more apt to continue an exercise routine, maintain better muscle control, are encouraged by the results and just feel better about themselves. Therefore, this invention provides a means in exercising muscles that otherwise are often ignored to the determent of the women themselves, and often to their partner.

Accordingly, it is an object of the present invention to provide a contraction resistance vaginal muscle exerciser constructed to provide a force or resistance for the isotonic exercise of the muscles of the urogenital region of the perineum.

Another object of the present invention is to provide an improved contraction resistance vaginal muscle exerciser that is constructed to provide an alternative to the kegel exercises currently used by women and recommended by physicians and other professionals.

A further object of the present invention is to provide a contraction resistance vaginal muscle exerciser adapted for contractual resistance to thereby substantially improve the development and toning of the transversus perinei superficial, bulbocavernosus, ischiocavernosus, traverse perinei profundus and the sphincter urethrae muscles.

Still a further object of the present invention is to provide a contraction resistance vaginal muscle exerciser adapted for obtaining better vagina and urethra control. It has been found that muscle development using the contraction resistance vaginal muscle exerciser results in better urethra control very rapidly. Typically, after child birth, and in particular after the birth of the second, third or more children, the muscles are in a condition that urethra control may be difficult. This problem is overcome using the contraction resistance vaginal muscle exerciser of this invention.

SUMMARY OF THE INVENTION

To accomplish the foregoing and other objects of this invention there is provided a contraction resistance vaginal muscle exerciser and more particularly to a resistance exerciser for the toning and development of the muscles of the urogenital triangle of the female.

The contraction resistance vaginal muscle exerciser of this invention includes a first member, a second member pivotally joined to the first member, an adjustment and locking means and a bias means. The first member and second member are joined at a rear of both members by the hinge to form the overall unit. The bias means is typically located between the members to bias the members apart. The adjustment and locking means is located to control the opening width between the first and second members and to maintain the exerciser in a closed position for insertion and storage.

The first member has a tapered head region for ease of insertion into the orifice of the vagina. The second member is joined with the first member from just behind the head region and extends to the rear of both the first and second members where they are attached with the hinge. Just behind the head region is a muscle positioning region consisting of an abrupt inward tapering, an extended flattened portion and a second abrupt upward tapering. This is the portion of the first and second member that open and close. The virginal muscles contract onto the muscle positioning region and the abrupt tappers maintains the contraction resistance vaginal muscle exerciser in the proper position.

Once inserted, the adjustment and locking means is adjusted such that the first and second members can open due to the bias. The adjustment of the width of the opening also adjusts the amount of bias being applied. The muscles are then contracted about this flattened portion to close the first and second members. When the muscles are relaxed the biasing means again spreads or opens the first and second members. This cycle is repeated to exercise the virginal muscles.

The above mentioned and other objects and features of the present invention will be better understood and appreciated from the following detailed description of the main embodiment thereof, selected for purposes of illustration and shown in the accompanying drawings.

DETAILED DESCRIPTION

Figure 1:
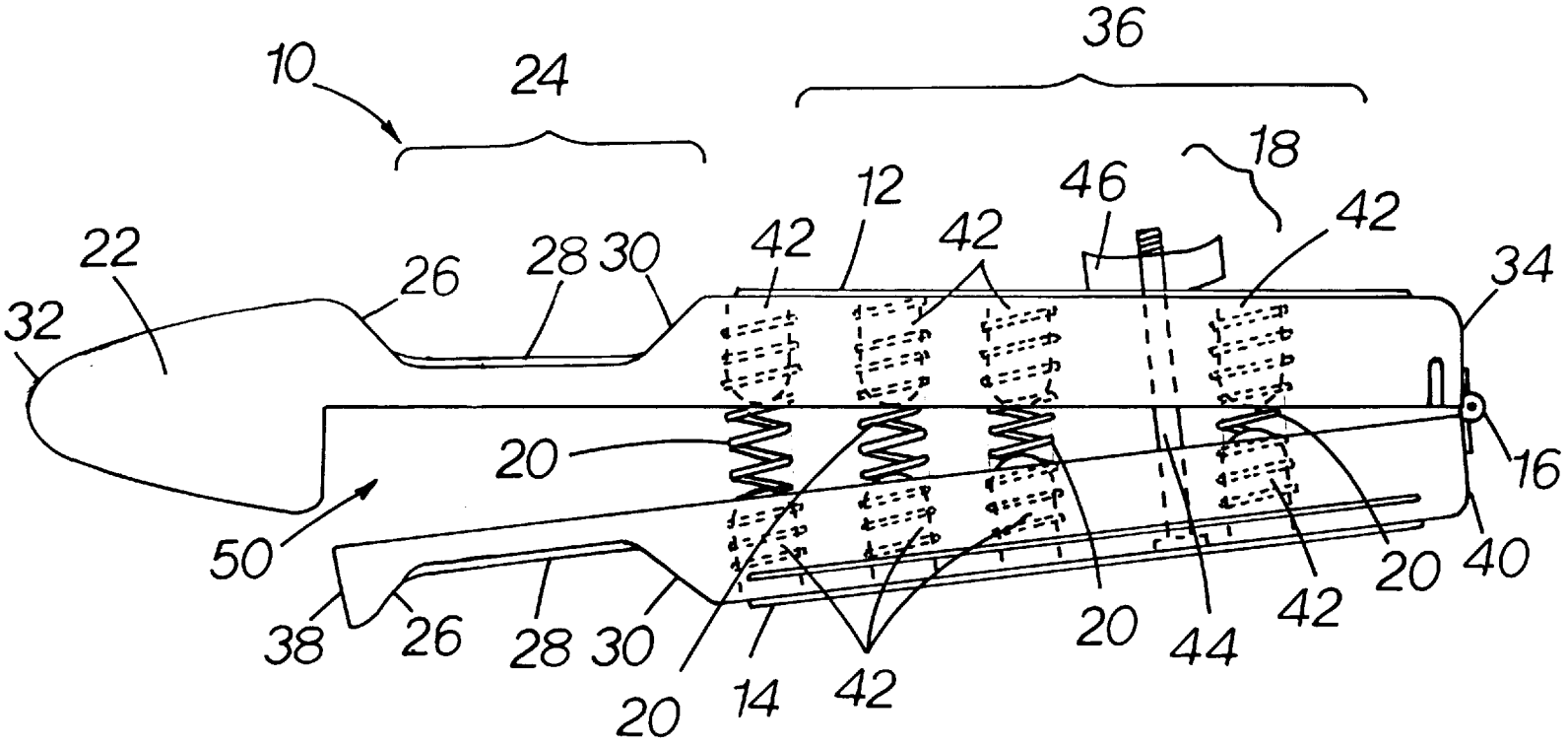
FIG. 1 is a side view showing the contraction resistance vaginal muscle exerciser in an open position.

Referring now to the drawings there is shown the preferred embodiment for the contraction resistance vaginal muscle exerciser 10 of this invention. The preferred embodiment is the best mode contemplated at the time of the invention. The preferred embodiment and best mode contemplated as illustrated and described herein is not to be considered the limiting factor. Rather the limiting factor is the scope and limitation as described in the claims.

The contraction resistance vaginal muscle exerciser 10 in general has a first member 12, a second member 14, a hinge 16, an adjustment and locking means 18, and a bias means 20. The first member 12 and second member 14 are pivotally joined at a second end of both the first and second members 12 and 14 by the hinge 16 to form the overall unit. The bias means 20 is located between the members 12 and 14 to bias the members 12 and 14 from a closed position to an open position. The adjustment and locking means 18 is located to control the opening width between the first and second members 12 and 14, for controlling the amount of bias, and to maintain the exerciser 10 in a closed position for insertion and storage.

The first member 12 has a tapered head region 22 for ease of insertion into the orifice of the vagina. The second member 14 is joined with the first member 12 from just behind the head region 22 and extends to the second ends of the combined unit of the first and second members 12 and 14, where they are pivotally attached with the hinge 16. Just behind the head region 22 is a muscle positioning region 24 consisting of an abrupt inward tapering or first transition 26, an extended flattened portion 28, and an abrupt upward tapering or second transition 30. The virginal muscles contract onto the muscle positioning region 24 and the abrupt tappers or transitions 26 and 30 maintains the contraction resistance vaginal muscle exerciser 10 in proper position during use. This is an important feature. Without the muscle positioning region the contraction resistance vaginal muscle exerciser 10 could not be properly used.

Once inserted, the adjustment and locking means 18 is adjusted such that the first and second members 12 and 14 can open due to the bias from the bias means 20. The adjustment of the width of the opening adjusts the amount of bias being which must be applied to close the opening between the first and second members 12 and 14. The muscles are then contracted about the muscle position region 24 to close the first and second members 12 and 14. When the muscles are relaxed the biasing means 20 again spreads or opens the first and second members 12 and 14. The cycle of contracting the muscles and relaxing is repeated to exercise the virginal muscles.

The preferred embodiment and the best mode contemplated of the contraction resistance vaginal muscle exerciser 10 of the present invention are herein described. However, it should be understood that the best mode for carrying out the invention hereinafter described is offered by way of illustration and not by the way of limitation. It is intended that the scope of the invention include all modifications that incorporate its principle design features.

The first member 12 provides the principal member of the contraction resistance vaginal muscle exerciser 10. The first member 12 has a first end 32 with a tapered head region 22 and a second end 34. Half the muscle positioning region 24 is located behind or after the tapered head region 24 as headed from the first end 32 to the second end 34 on the first member 12. The other half of the muscle positioning region 24 being reciprocally located on the second member 14. A handle region 36 extends from the end of the muscle positioning region 24 to the second end 34. One side of the first member 12 along a longitudinal center line has a vacant area extending from just behind the head region 22 to the second end 34. This area forms a receiving area 50 for the second member 14.

Figure 6:
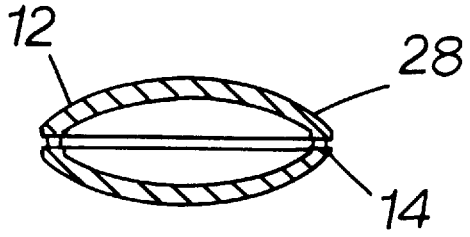
FIG. 6 is a sectional view of the flattened portion of the muscle positioning region.
Figure 5:
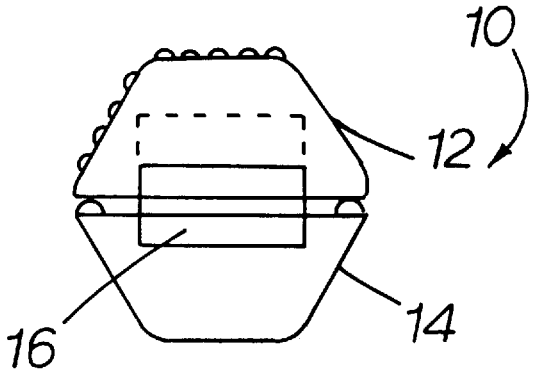
FIG. 5 is an end view of the contraction resistance vaginal muscle exerciser.

In the preferred embodiment, the length of the first member from the first end 32 to the second end 34 is ten inches with a diameter of one and a half inches. The head region consists of the first two inches. The muscle positioning region 24 is two and three quarters inches. The handle region 36 is five and one quarter inches. The preferred embodiment has a head region 22 that is circular in circumference while the handle area 36 is hexagonal in shape. The flattened region 28 of the muscle positioning region 24 will have an oval shape as illustrated in FIG. 6.

The second member 14 has a first end 38 and a second end 40. The second member 14 fits within the receiving area 50 on the first member 12. The second end 34 of the first member 12 and the second end 40 of the second member 14 are pivotally attached with hinge 16. The second member 14 has half of the muscle positioning region 24 that corresponds in location to the other half of the muscle positioning region 24 on first member 12. The second member 14 does not have a head region 22. Rather the first end 38 begins with the first transition 26 which fits within the receiving area 50 on the first member 12 just behind the head region 22.

The size of the second member 14 corresponds generally to the size of the receiving area 50. The length will be fraction of an inch shorter to provide clearance for the second member 14 to pivotally open and close in respect to the first member 12. In the preferred embodiment, the length will be a fraction of an inch smaller than eight inches, the length of the receiving area 50. A handle area 36 corresponds to the handle area 36 on the first member 12. The overall shape of the handle area, as stated above, will be hexagonal with a diameter of one and a half inches, in the preferred embodiment.

The first and second members 12 and 14 of the contraction resistance vaginal muscle exerciser 10 will typically be made of plastic. However, other suitable material could also be used. The material used must be readily cleanable in addition to being strong and sturdy to prevent breakage. The material must also be smooth and non-irritating to the flesh. Plastic has all these characteristics and more, as such plastic is used in the preferred embodiment.

Figure 2:
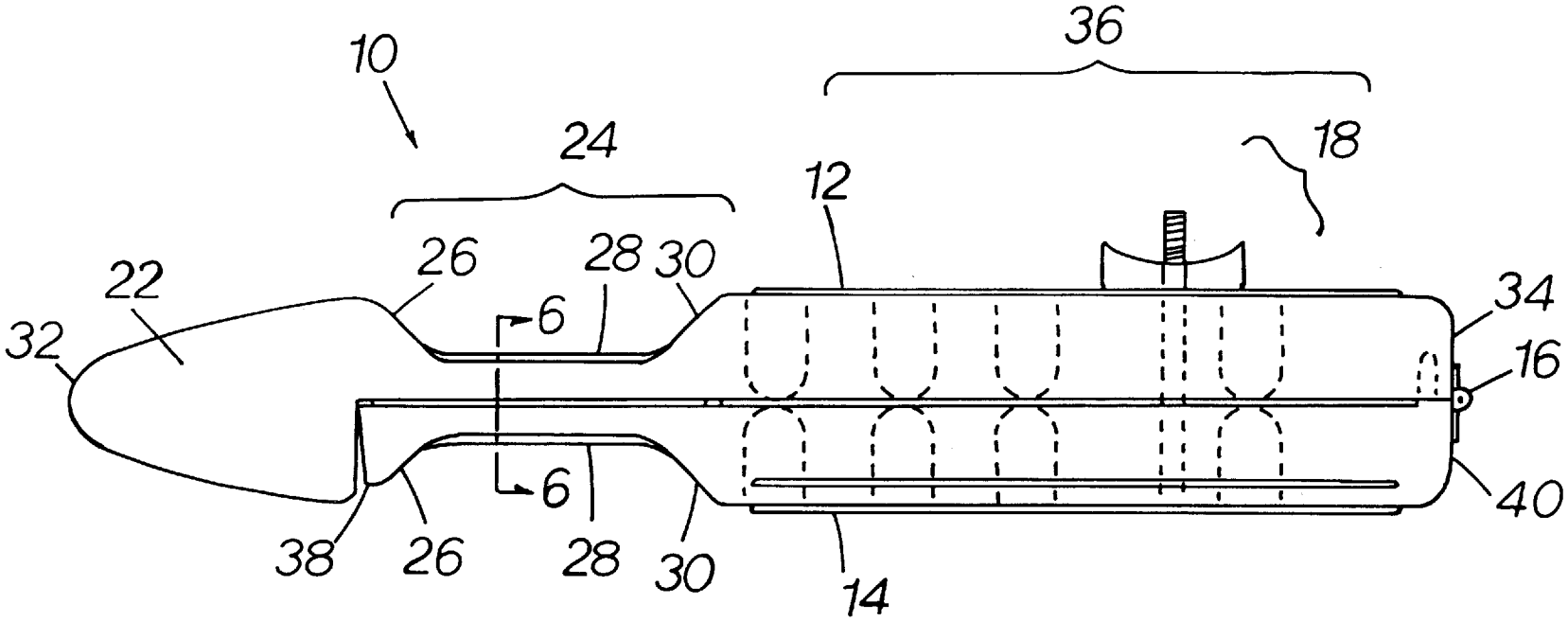
FIG. 2 is a side view showing the contraction resistance vaginal muscle exerciser in a closed position.
Figure 3:
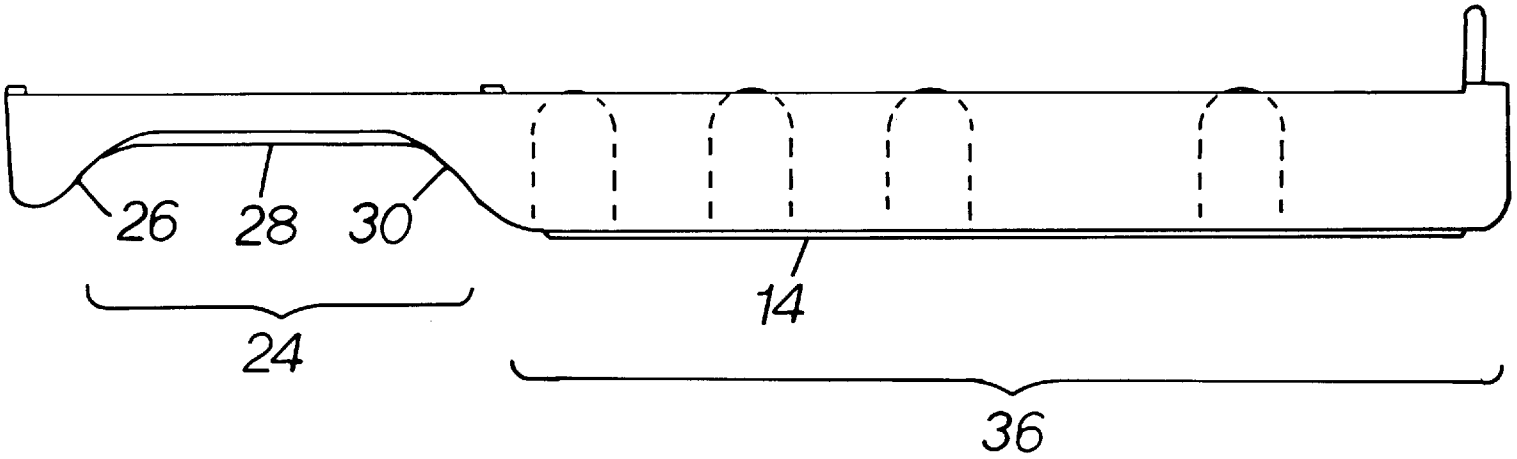
FIG. 3 is a side view of the second member.
Figure 4:
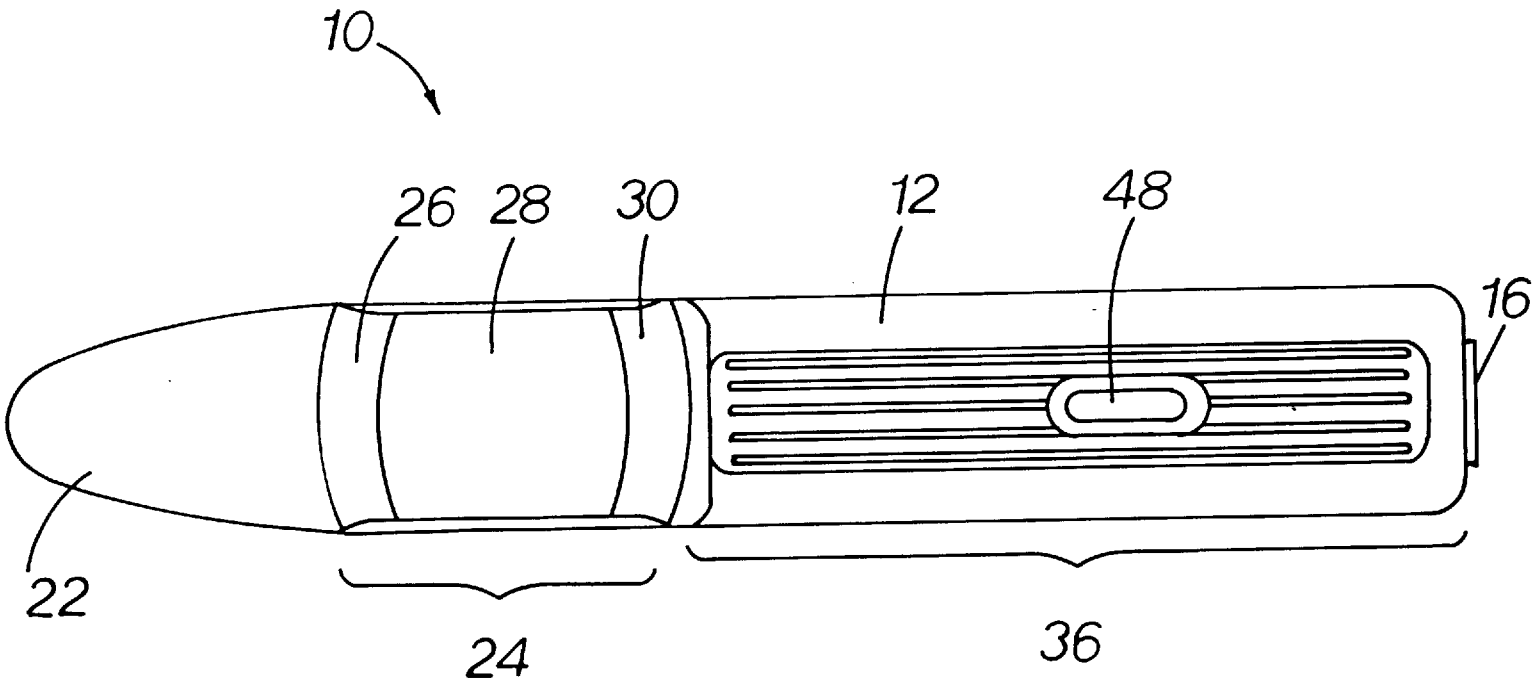
FIG. 4 is a top view of the first member of the contraction resistance vaginal muscle exerciser.

The biasing means 20 is used to bias the first member 12 and the second member 14 from a closed position as shown in FIG. 2 to an open position as shown in FIG. 1. The bias means 20 provides the resistance for the contraction of the muscles by spreading or opening the first member 12 and the second member 14.

In the preferred embodiment, the biasing means 20 consists of a plurality of springs, also having reference numeral 20. The springs 20 being located between the first member 12 and the second member 14. The springs 20, in the preferred embodiment, are held in place by spring holding projections 42 located inside of the handle region 36 in both the first member 12 and second member 14. Any number of springs 20 could be used. However, as illustrated, bias means 20 consists of four coil springs 20 located between the second transition 26 and the second ends 24 and 40 of the first and second members 12 and 14. The springs 20 can be made stainless steel which provide rust resistance and which are easily cleaned Stainless steel springs are being offered as an option.

A scissors type spring, not illustrated, could also be used as the bias means 20. In this embodiment the scissor type spring would be placed between the first and second member 12 and 14, just as with the coil springs. However, the pivot position of the scissor type spring would be placed near the second ends 34 and 40 as determined by the specific spring being used. The strength of the torque between the extended arm and the length of the arm would of course determine the exact location.

In the preferred embodiment, as stated, aa plurality of springs 20 are used. This method provides a very convenient means of adjusting the amount of total bias that can be applied. Adjustment can be made by the number of springs used, one to four as illustrated, and by positioning. If a single spring is used, it can be placed along any of the four sets of spring holding means 42. The closer to the second ends 34 and 40 the more bias is applied. The closer to the muscle positioning region the less bias is applied.

This method of using a plurality of springs 20 is very useful, in that the amount of bias can be easily increased as muscles develop. At first maybe only a single spring 20 would be used to provide a lesser amount of bias. As the muscle develops, a second spring 20 could be added. The springs 20 could also be positioned in different positions to provide various amounts of bias as desired. When muscles are developed, all four springs 20 could be used to provide maximum amount of bias. In addition, the coil strength of the springs 20 can be varied between different sets of springs 20 or between different springs in a single set. A variety of bias options are available using this method.

The adjusting and locking means 18 is used to the adjust the overall amount of bias available from the biasing means 20 at any one time. The adjusting and locking means 18 also provides a means to lock the first member 12 and the second member 14 in a closed position. This position places the second member 14 completely within the receiving area 50 in the first member 12. Typically, the amount of bias available is determined by the amount of width of the opening between the first member 12 and second member 14. The adjusting and locking means 18 provides the means to adjust the opening between the members 12 and 14 from a completely closed position to a fully opened position. It also allows the members 12 and 14 to open to change springs 20 or change their location.

In the preferred embodiment, the adjusting and locking means 18 consists of a threaded post 44 and a handle 46 with a threaded bore therethrough. The threaded post 44 is attached to the inside of one of the members 12 or 14 at a location between the second transition 30 and the second end 34 or 40. The threaded post 44 extends from the inside of the member 12 or 14 through a slotted opening 48 on the opposite member 12 or 14. The threaded handle 46 is screwed onto the threaded post 44. As the handle 46 is screwed onto the threaded post 44 the opening between the first member 12 and the second member 14 transposes from an open position to a closed position.

In the embodiment as shown, the threaded post 44 is attached to the second member 14 and extends through the slotted opening 48 on the first member 12. Either arrangement are acceptable. Other methods or systems could also be utilized, as long as the opening width can be adjusted and the first and second members 12 and 14 can be held in a closed position.

The closed position of the first and second members 12 and 14 is important. The contraction resistance vaginal muscle exerciser 10 must be in the closed position for insertion into the orifice of the vagina.

The muscle positioning means 24 of the contraction resistance vaginal muscle exerciser 10 allows this apparatus to function properly. Without this feature, the contraction resistance vaginal muscle exerciser 10 would have a tendency to slide inward while the muscles are relaxed and the size of the opening is increasing due to the biasing means 20. During contraction of the muscles the contraction resistance vaginal muscle exerciser 10 would have a tendency of sliding outward. The arrangement of the muscle positioning means 24 provides the proper positioning of the muscles for proper operation and holds the contraction resistance vaginal muscle exerciser 10 in proper position throughout use. If the contraction resistance vaginal muscle exerciser 10 were to slide outward, the rapidly spreading first and second members 12 and 14 could cause injury or pain to the vagina area of the user.

The muscle positioning means 24 has a flattened portion 28, a first transition 26 and a second transition 28. The flattened portion 28 is located along the first member 12 behind the tapered head region 22 and along a corresponding area on the second member 14. The flattened portion 28 provides an area dedicated for muscle position on the contraction resistance vaginal muscle exerciser 10. The first transition 26 is an abrupt inward tapering from the outer perimeter of the end of the head portion 22 and the flattened portion 28. The second transition 30 is the area from the flattened portion 28 to the outer perimeter of the forward end of the handle region 36. The first and second transitions 26 and 30 provide a means to properly position and hold the contraction resistance vaginal muscle exerciser 10 within the muscles being exercised. The first transition 26 helps to prevent the contraction resistance vaginal muscle exerciser 10 from accidently slipping outward during contraction of the muscles. The second transition 30 helps to prevent the contraction resistance vaginal muscle exerciser 10 from slipping inward and past the muscles being exercised during relaxation of the muscles.

In use, the contraction resistance vaginal muscle exerciser 10 is placed in a closed position using the adjusting and locking means 18. The contraction resistance vaginal muscle exerciser 10 is slipped into the orifice of the vagina with the head region 22 being first. The tapering of the head region 22 generally allows the contraction resistance vaginal muscle exerciser 10 to be easily inserted. Lubricants may be used but are not generally required nor recommended. The contraction resistance vaginal muscle exerciser is pushed inward until the muscles of the urogenital region relax onto the flattened portion 28 on the muscle positioning means 24. In this position, the contraction resistance vaginal muscle exerciser 10 is "locked" in position. The flattened portion 28 is positioned between the transversus perinei muscles and the sphincter urethrae. The transitions 26 and 30 are positioned on the inside and outside of the muscles to provide a "cradle" for the muscles.

Once inserted and positioned, the adjusting and locking means 18 is adjusted to open or separate the first and second members 12 and 14. As the contraction resistance vaginal muscle exerciser 10 opens, the muscles are also stretched opened. The female then contracts the vaginal muscles which closes the opening. This is done using a kegel type exercise. However, resistance is encountered to provide an isotonic exercise rather than an isometric type exercise. The amount of closure depends on the condition of the muscles and amount of bias being overcome. As the muscles become more developed the opening will be closed all the way to a closed position. As the bias is increased and the amount of opening between the first and second members is increased the more force is needed to close the opening and thus stronger and more developed muscles are needed.

As a regular routine is developed, the increase in muscle tone and development is readily observable. This is due to observing the actual settings on the contraction resistance vaginal muscle exerciser 10, the actual observance of the vaginal muscles and the feel of the muscles contraction and increased pleasure from the increased stamina available.

Having described the invention in detail, those skilled in the art will appreciate that modifications may be made of the invention without departing from the spirit of the inventive concept herein described.

Therefore, it is not intended that the scope of the invention be limited to the specific and preferred embodiments illustrated and described. Rather, it is intended that the scope of the invention be determined by the appended claims and their equivalents.

What is claimed is:

1. A contraction resistance vaginal muscle exerciser comprising:

a first member, said first member having a first end with a tapered head region and a second end, said first member having a receiving area behind said tapered head region extending to said second end;

a second member with a first end and a second end, said second member fitting within said receiving area on said first member, said second end of said first member and said second end of said second member pivotally attached;

a biasing means to bias said first member and said second member from a closed position to an open position;

an adjusting and locking means to adjust bias of said biasing means and providing a means to lock said second member in said closed position within said receiving area in said first member; and a muscle positioning means, said muscle positioning means providing a means to properly position said contraction resistance vaginal muscle exerciser within the orifice of the vagina and maintaining said contraction resistance vaginal muscle exerciser in proper position while in use.

2. The contraction resistance vaginal muscle exerciser as set forth in claim 1 in which said biasing means comprises a plurality of springs, said springs being located between said first member and said second member.

3. The contraction resistance vaginal muscle exerciser as set forth in claim 2 in which said plurality of springs consists of four coil springs located between said second transition and said second end of said first and second members.

4. The contraction resistance vaginal muscle exerciser as set forth in claim 2 in which said biasing means consist of a plurality of stainless steel coil springs.

5. The contraction resistance vaginal muscle exerciser as set forth in claim 1 in which said biasing means comprises a scissors type spring.

6. The contraction resistance vaginal muscle exerciser as set forth in claim 1 in which said adjusting and locking means comprises a threaded post and a handle with a threaded bore, said threaded post attached to the inside of said first member at a location between said second transition and said second end and having a length such that said threaded post extends through an opening on said second member, said handle being screwable onto said threaded post, as said handle is screwed onto said threaded post said first member and said second member transposes from an open position to a closed position.

7. The contraction resistance vaginal muscle exerciser as set forth in claim 1 in which said muscle positioning means comprises a flattened portion, a first transition and a second transition, said flattened portion located along said first member behind said tapered head region and along a corresponding area on said second member, said flattened area providing an area for muscle position, and said first transition being the area from said tapered head region to said flattened portion, said first and second transitions providing a means to properly position said contraction resistance vaginal muscle exerciser within the muscles being exercised, said first transition to prevent said contraction resistance vaginal muscle exerciser from accidently slipping outward and past the muscles during use and said second transition to prevent said contraction resistance vaginal muscle exerciser from slipping inward past the muscles being exercised.

8. A contraction resistance vaginal muscle exerciser comprising:

an elongated first member having a tapered head region and a second end;

a second member pivotally attached to said first member at said second end of said elongated first member, said first and said second members forming a unit;

one or more springs between said first member and said second member to provide bias of said first member and said second member from a closed position to an open position; and a muscle positioning means, said muscle positioning means having a flattened portion, a first transition and a second transition, said flattened portion located along said first member behind said tapered head region and along a corresponding area on said second member, said flattened area providing an area for muscle position, said first transition being an abrupt tapering from said tapered head region to said flattened portion, said second transition being an abrupt outward tapering from said flattened portion to an outer perimeter of said unit, said first and second transitions providing a means to properly position and hold said contraction resistance vaginal muscle exerciser within the muscles being exercised.

9. The contraction resistance vaginal muscle exerciser as set forth in claim 8 further comprising an adjusting and locking means to adjust the overall bias of said one or more springs and providing a means to lock said unit in said closed position.

10. A method of providing isotonic contraction resistance exercise for the vaginal muscles in which the steps comprise:

forming a unit having a tapered head region and a first member and a second member behind said tapered head which separate from a closed to an open position;

biasing said first and second members apart from a closed position to an open position;

providing a muscle positioning means on said first and second members for proper positioning and for holding said unit within the muscles being exercised;

inserting and properly positioning said unit in the orifice of the vagina while said unit is in a closed position;

adjusting the amount bias and width of opening between said members with an adjusting means;

contracting the muscles of the urogenital region to close the width of the opening between said first and said second members, resistance to the contraction of the muscles being provided by the biasing means of said unit;

relaxing the muscles to allow said first and second member of said unit to open again to stretch said muscles; and repeating the cycle of contracting and relaxing said muscles to isotonically exercise the muscles of the vagina.

* * * * *